US005143520A

United States Patent [19]

Richard et al.

[11] Patent Number: 5,143,520

[45] Date of Patent: Sep. 1, 1992

[54] METHOD OF AND RADIANT COOLER FOR RADIANT COOLING OF PRODUCT MASS STREAM DISCHARGED FROM A GASIFICATION REACTOR

[75] Inventors: Hans-Günter Richard, Essen; Gerhard Wilmer, Hattingen, both of Fed. Rep. of Germany

[73] Assignee: Krupp Koopers GmbH, Essen, Fed. Rep. of Germany

[21] Appl. No.: 452,234

[22] Filed: Dec. 18, 1989

[30] Foreign Application Priority Data

Dec. 30, 1988 [DE] Fed. Rep. of Germany ..... 3844347

[51] Int. Cl.[5] ..... C10J 3/20; C10J 3/84; C10J 3/52; C10J 3/48

[52] U.S. Cl. ..... 48/87; 48/77; 48/197 R; 48/210; 165/47; 165/134.1; 122/7 R

[58] Field of Search ..... 165/47, 134.1; 48/77, 48/87, 210, 197 R; 122/7 R

[56] References Cited

U.S. PATENT DOCUMENTS

| | | | |
|---|---|---|---|
| 4,377,132 | 3/1983 | Koog et al. | 48/77 |
| 4,436,530 | 3/1984 | Child et al. | 48/197 R |
| 4,437,864 | 3/1984 | Goms et al. | 48/87 |
| 4,478,606 | 10/1984 | Dorling et al. | 48/77 |
| 4,874,037 | 10/1989 | Papst et al. | 165/47 |
| 4,936,871 | 6/1990 | Wilmer et al. | 48/197 R |
| 4,959,078 | 9/1990 | Ziegler | 48/77 |

FOREIGN PATENT DOCUMENTS

| | | | |
|---|---|---|---|
| 3409030 | 9/1985 | Fed. Rep. of Germany . | |
| 3725424 | 7/1988 | Fed. Rep. of Germany . | |
| 2027444 | 2/1980 | United Kingdom | 48/197 R |
| 2108005 | 5/1983 | United Kingdom | 48/197 R |

*Primary Examiner*—John K. Ford
*Attorney, Agent, or Firm*—Michael J. Striker

[57] ABSTRACT

A method of radiant cooling of a product gas mass stream discharged from a gasification reactor and loaded with particles in a cylindrical radiant cooler with a radiant cooling casing comprises the steps of subdividing the product gas mass stream into concentric cylindrical layer streams by cylindrical radiant cooling walls arranged at a distance from the radiant cooling casing, adjusting layer thickness of the cylindrical layer streams to provide a high radiant heat exchange, and cooling regions of the product gas mass stream which flow to the radiant cooling walls in a pre-cooling region to a temperature caking of the particles. A radiant cooler for radiant cooling of a product gas mass quantity from a gasification reactor, comprises a cylindrical radiant cooling casing having an axis, means forming a product gas inlet for supplying the product gas mass stream and an outlet for a radiant-cooled product gas, additional radiant cooling walls located in the region of the radiant cooling casing, the additional radiant cooling walls being formed as cylindrical radiant cooling walls and arranged in a flow direction of the product gas after the pre-cooling region concentrically relative to one another and at a distance from the radiant cooling casing to form cylindrical layer streams.

14 Claims, 2 Drawing Sheets

METHOD OF AND RADIANT COOLER FOR RADIANT COOLING OF PRODUCT MASS STREAM DISCHARGED FROM A GASIFICATION REACTOR

BACKGROUND OF THE INVENTION

The present invention relates to a method of and a radiant cooler for radiant cooling of a product mass stream discharged from a gasification reactor.

More particularly it relates to a method of and a device for radiant cooling of a product mass stream which is discharged from a gasification reactor for cold pressure gasification and is loaded with particles, in a cylindrical radiation cooler with a radiation cooling casing. The invention also deals with a radiation cooler for the above-specified method.

Methods and devices of the above mentioned general type are known in the art. It is to be understood that the radiant cooler has a respective housing. The radiant cooler casing and further radiant walls used within the invention are composed in known manner of finned walls or similar, for example, box-shaped constructions. The radiant cooling walls and the radiant cooling casings are provided with knocking devices or the like for cleaning. During the reactions which are performed in a gasification reactor between the fuel, for example finely distributed coal or similar carbon carrier, and the gasifying medium such as oxygen and in some cases water steam, the gasification temperatures reach approximately 1,200° C.-1,700° C. A product gas stream which discharges from such a gasification reactor contains ash particles which at these temperatures lead to caking on the walls, heat exchange walls and radiant cooling walls which guide the product gas stream. The radiation of such a product gas stream is a gas and particle radiation.

One of the known methods is disclosed for example in the German document DE 3,725,424. Here the radial radiant cooling walls extend into the region of the radiant cooling casing into the product gas mass stream. This increases the heat exchange surfaces. However, they achieved radiant cooling requires further improvements. For a predetermined cooling output within the frame of the known construction a less compact, large volume radiant cooler is required.

SUMMARY OF THE INVENTION

Accordingly, it is an object of the present invention to provide a method of radiant cooling and a radiant cooler which provide for further improvement of the above mentioned characteristics.

More particularly, it is an object of the present invention to provide a method which is characterized by substantially improved radiant cooling and permits operation of a relatively compact radiant cooler as compared with known coolers.

It is also an object of the present invention to provide a new radiant cooler which performs the new inventive method of radiant cooling.

In keeping with these objects and with others which will become apparent hereinafter, one feature of the present invention resides, briefly stated, in that the product gas mass stream is subdivided into concentric cylindrical layered streams by cylindrical radiant cooling walls arranged at a distance from the radiant cooler casing, the layer thickness is designed for a high radiant heat exchange, and the regions of the product gas mass stream which flow to the radiant cooling walls are cooled down in a pre-cooling region to a temperature which excludes the caking of the particles.

The pre-cooling region is located generally between the product gas inlet and the cylindrical radiant cooling walls. The pre-cooling region can have however be also connected before the radiant cooler. In both cases impact surfaces and/or contact surfaces can be used.

The layer thickness of the flowing product gas in the cylindrical layer streams adjusted for a high radiation heat exchange is determined physically. In connection with this, it is emphasized that the excited molecules and also the particles in the event of the presence of the particles contribute to the radiation of a gas. In the region of thinner gas layers of the product gas, the rule is maintained that the radiation heat exchange monotonically increases with increasing thickness of the gas layer. Thin gas layers are such layers in which the dust content and the gas provide for no disturbing shielding for the radiation heat transfer in the radiation heat exchange between a wall and the gas layer. In the region of thicker gas volumes, the gas layers which lie between wall-remote gas layers of the product gas and the wall and provide for the radiation heat exchange act as radiation shields. The heat uncoupling by the radiation exchange between gas and wall decreases with increasing thickness of the gas volume, since the wall-removed gas layers are shielded by the gas and the particles. If both phenomenon are superposed, this will lead to the result that the radiation heat exchange increases with increasing layer thickness for the thin gas layers, and decreases with increasing thickness for the thick gas layers. This means that such a layer thickness must be provided with which the radiation heat exchange is maximal. Due to other physical parameters which fluctuate, such a layer thick region is adjusted. The maximal layer thickness can be determined for a predetermined product gas experimentally in a simple manner. The expression "adjusted for a high radiation heat exchange" means in this invention that the layer thickness must not deviate from the thusly determined value in a disturbing manner.

The above explained relations with their optimization results with respect to the layer thickness can be understood from the following thermodynamic formula. First of all, the heat exchange is determined by radiation between an isothermal, homogeneous, thin gas layer and a cooling surface with consideration of the transmission losses in the gas element under examination. The radiation heat exchange between gas and wall can be determined approximately as heat exchange between two plates:

$$\dot{q}'' = \epsilon\delta(T_{gas}^4 - T_{wall}^4)$$

wherein $\dot{q}''$: is a heat stream density by radiation exchange $\epsilon$: is a total emission degree $\delta$: is a radiation constant for the black irradiator T: are temperatures of the gas or the wall The total emission degree $\epsilon$ is calculated from the emission degree of the gas layer and the emission degree of the wall. The emission degree of the gas layer can be approximately determined as $$\epsilon_{gas} = 1 - \exp(-k\delta)$$

with k : an extinction coefficient $\delta$: a thickness of the gas layer

The extinction coefficient can be determined approximately additively from the contribution of the dust and the radiating gas components, as follows:

$$k = k_{dust} + k_{CO_2} + k_{H_2O} + k_{CO} + \ldots$$

The extinction coefficient of the dust is dependent on the dust surface, its absorption properties and the loading. For the heat stream density the following equation is provided:

$$q'' = \frac{1}{\frac{1}{1 - \exp(-k)} + \frac{1}{\text{wall}} - 1} \sigma(T_{gas}^4 - T_{wall}^4)$$

It shows the functional dependency of the radiation heat exchange between gas and wall from the thickness of the gas layer. It can be seen that for thin gas layer, the radiation heat exchange monotonically increases with increasing thickness the gas layer.

The next consideration deals with a thick gas layer as a collection of several thinner gas layers. A gas layer is composed of different individual layers with a thickness of 1/k parallel to the wall, and the layer located near the wall is identified as layer 1 while the layer located farthest from the wall is identified with n. All individual layers are arranged in radiation exchange with one another. It has been shown that the transmission degree $\tau$ which is a portion of the radiation not absorbed on the optical path of radiating gas element to the wall, strongly depends from the thickness of the radiated-through gas layer. The transmission degree $\tau$ between the i-th gas layer and the wall is determined without consideration of the transmission losses in the i-th gas element as $$\tau = \exp(1 - i)$$

| $i$ | 1 | 2 | 3 | 4 | 5 | 6 | 7 |
|---|---|---|---|---|---|---|---|
| $\tau$ | 1.00 | 0.368 | 0.135 | 0.05 | 0.018 | 0.007 | 0.003 |

The table shows the transmission degree between the wall and the seven gas layers located near the wall. It follows from the wall that only the first three layers near the wall is in an efficient radiation exchange with the wall. The radiation of the layers located far from the wall is only in the radiation exchange with their adjacent gas layers. The wall-removed gas layers cannot give their heat to the wall by direct radiation heat exchange, but instead exchange in radiation with the wall-close gas layer. These exchanges in radiation with the next wall-close gas layer, up to the wall-close gas layers which directly irradiate on the wall. In other words, the gas layers lying between the wall-remote gas layers and the wall act themselves as radiation screens. Therefore, the heat uncoupling by radiation exchange between gas and wall reduces with increasing thickness of the gas layer, since the wall-remote gas layers are stronger shielded by the wall.

The evaluation of both considerations for thin and for thick layer thicknesses leads to the different results in that the radiation heat exchange increases with increasing layer thickness for thin gas layers, while it decreases for thick gas layers. As a result, there is a layer thickness region in which the radiation heat exchange is maximal.

This value cannot be indirectly determined from the above considerations. The optimal value $\delta$ is selected as double amount of the gas layer, with which the emission degree amount to approximately 0.86.

The mathematical dependency can be expressed as follows:

$$\delta = \frac{4}{k} = \frac{4}{k_{dust} + k_{CO_2} + k_{H_2O} + k_{CO} + \ldots}$$

This value which simultaneously determines the radial distance between two cylinder casings arranged in one another in the inventive radiant cooler, is selected so that the gas which flows in the center between two cylindrical casings is in heat exchange with the wall of the cylindrical casing by gas and particle radiation. A radiant cooler designed in such a manner has then the minimal heat transfer surface. A region between 0.5–3.0 times of the above mentioned optimal value leads to advantageously low heat transfer surfaces.

Within the spirit of the present invention, several possibilities of further constructions and designs are possible. It is possible to perform the inventive method so that the product gas mass stream is subdivided into cylindrical layer streams which are composed of wall-close, thin partial streams in the sense of the heat exchange by radiation between a gas and a wall. In accordance with a preferable embodiment of the invention which is especially recommended when a product gas is produced by the coal pressure gasification, the product gas mass stream is subdivided into cylindrical layer streams with layer thickness substantially corresponding to the double amount of the thickness of a layer which has an emission degree of approximately 0.86. For ensuring that no disturbing caking of the ash particles is produced, the central regions of the product gas mass stream are brought downstream with the cylindrical radiation cooling walls in contact to a greater degree than the regions which are located further outside to the radiation cooling casing. It is always recommended to provide the product quantity mass stream with a free flow profile which is free from transverse streams. The flow shape can be adjusted to be both laminar and also turbulent.

The inventive method ensures very compact construction of respective radiant cooler. In accordance with the present invention a radiant cooler is proposed for performing the method. In addition to the housing, it has a cylindrical radiation cooling casing, a product gas inlet arranged at the cylinder axis, and an outlet for the radiation-cooled product gas arranged coaxially to the cylinder axis. In the region of the radiation cooling casing, additional radiation cooling walls are provided. The inventive radiant cooler is characterized in that additional radiation cooling walls are formed as cylindrical radiation cooling walls, and they are arranged in a flow direction of the product gas after a pre-cooling region concentrically relative to one another and at a radial distance from the radiation cooling casing and from one another to form cylindrical layer streams.

In accordance with a preferable embodiment of the invention, the pre-cooling region is formed by a substantially parabolic-rotation, insert-free chamber which is connected with the product gas inlet and is formed parabola-shaped narrower downstream and surrounded by the radiation cooling casing. The cylindrical radiation cooling walls with their flow edges are connected in accordance with the parabolic shape to the pre-cooling region. It is to be understood that the radiation cooling casing and the cylindrical radiation cooling walls have such a length in the flow direction of the product gas which is designed in correspondence with the low of the radiation cooling, so that the product gas is sufficiently cooled down. The radiation heat exchange is especially high in the sense of the present invention when the cylindrical radiation cooling walls are spaced from the radiation cooling casing at a distance which is 0.5–3 times the thickness of a layer an emission degree of approximately 0.86.

Generally, the radiation cooling walls are arranged concentrically and equidistantly, and the thusly defined distance corresponds to the distance of the respective radiation cooling wall from the radiation cooling casing. The distances can advantageously be greater toward the central axis of the radiation cooler, so that the same heat exchange occurs in all radiation cooling walls. In other words, practically identically high partial quantity streams flow in the cylindrical layer streams.

The novel features which are considered as characteristic for the invention are set forth in particular in the appended claims. The invention itself, however, both as to its construction and its method of operation, together with additional objects and advantages thereof, will be best understood from the following description of specific embodiments when read in connection with the accompanying drawings.

DESCRIPTION OF THE PREFERRED EMBODIMENTS

Figure 1:
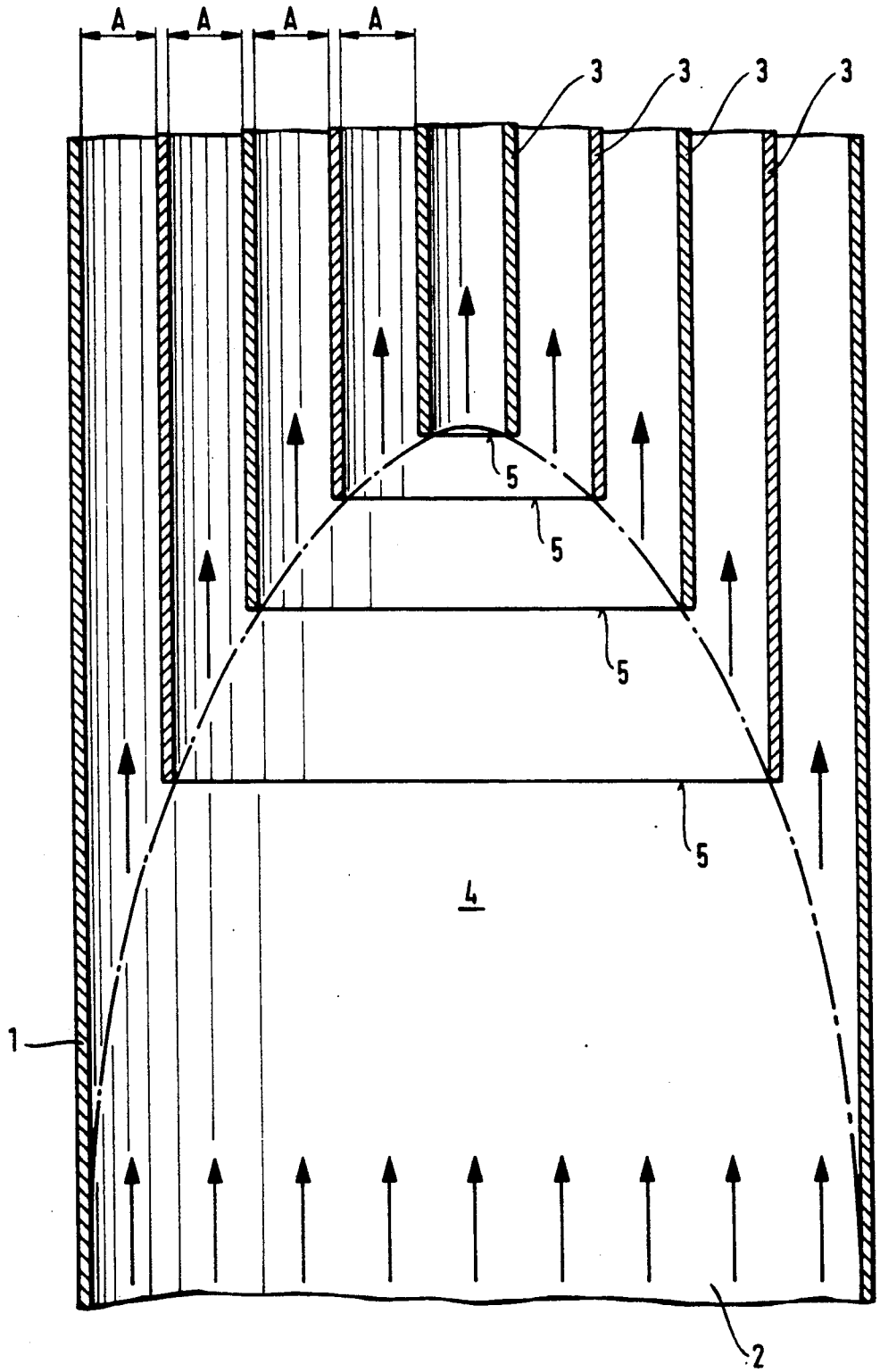
FIG. 1 is a view showing a section of a radiation cooler in accordance with the present invention for performing a method of the invention.

A radiant cooler in accordance with the present invention shown in FIG. 1 is generally cylindrical and has a cylindrical radiant cooling casing 1 which is built in a respective housing in a known manner. A product gas inlet is identified with reference numeral 2. An outlet for the radiation-cooled product gas is located at the cylinder axis coaxially with the product gas inlet 2 and is not shown in the drawings.

Additional radiation cooling walls are arranged in the region of the radiation cooling casing 1. They are formed as cylindrical radiation cooling walls 3 and arranged concentrically relative to one another. In the flow direction of the product gas they are located after a pre-cooling zone 4. The radiation cooling walls 3 are arranged at a radial distance A from the radiation cooling casing 1 and from one another to form cylindrical layer streams.

The pre-cooling region in the shown example is formed as a substantially parabolic-rotation, insert-free chamber. The chamber is connected with the product gas inlet 2 and narrows downstream in a parabolic shape. It is surrounded by the radiation cooling casing 1, so that the pre-cooling is achieved by a sufficiently long flow path. The cylindrical radiation cooling walls 3 are connected with their flow edges 5 with the pre-cooling region 4 to maintain the parabolic shape. As a result the product gas mass stream is subdivided by the cylindrical radiation cooling walls 3 into concentric cylindrical layer streams, and their layer thicknesses are adjusted for a high radiation heat exchange. The regions of the product gas mass flow which flow to the radiation cooling walls 3 are cooled down in the pre-cooling region 4 to such a temperature which is sufficient for excluding the caking of the particles.

Figure 2:
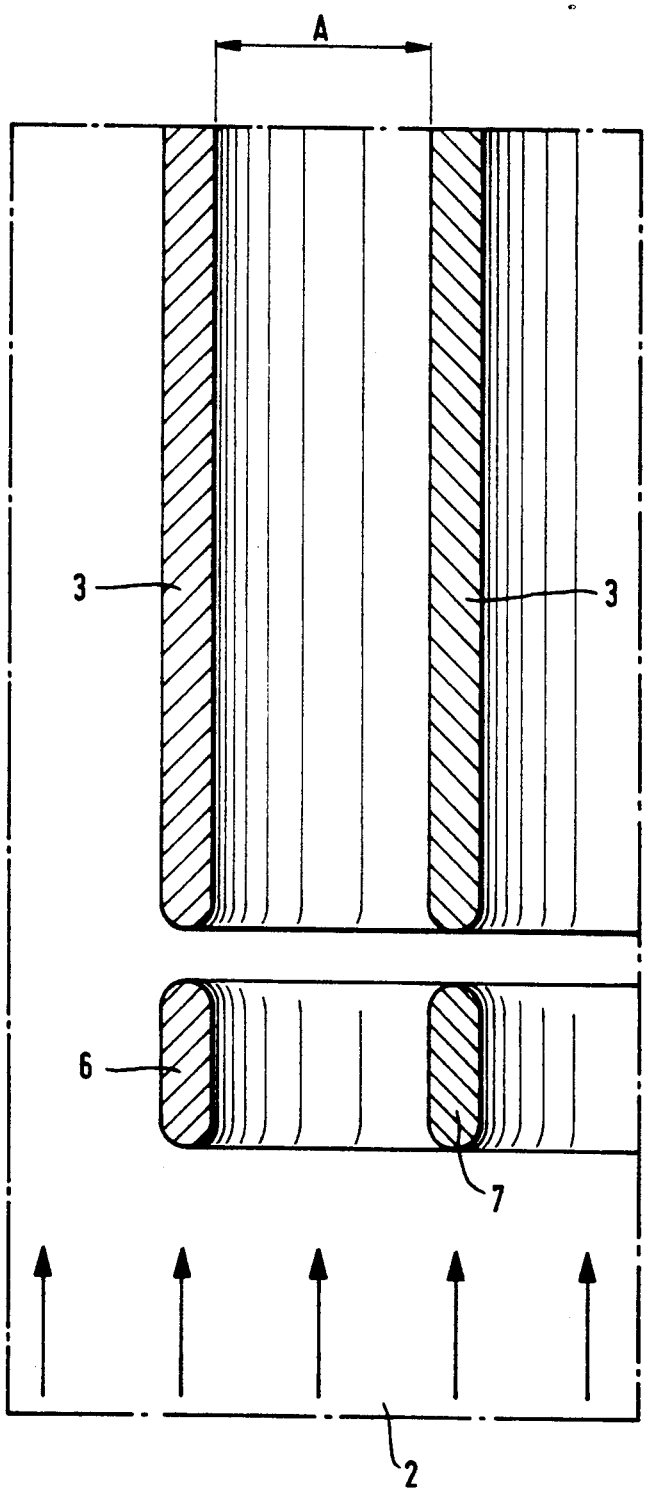
FIG. 2 is a view showing an inventive radiant cooler in accordance with another embodiment of the present invention.

FIG. 2 shows a radiant cooler in accordance with a different embodiment of the present invention. The radiation cooling casing which surrounds the concentric radiation cooling walls 3 is not shown in the drawing. Two neighboring cylindrical radiation cooling walls which are arranged concentrically relative to one another at the above described distance A are identified with reference numeral 3 and used for example in a greater number. All concentric radiation cooling walls 3 start at the same height in the gasification reactor and the hot product gas flows around them. For preventing caking of impacting pasty particles on the end surfaces of the radiation cooling walls 3, an impact and/or contact surface 6 and 7 are arranged before the heat exchange surfaces 5. The purpose of the surfaces 6 and 7 are not a heat transfer, but instead the catching of the pasty particles and the contact of the gas flow before entering in the intermediate space between the radiation cooling walls 3. The impact surfaces 6 or the contact surfaces 7 are arranged in alignment with the heat exchange surfaces and can be mechanically connected with the latter or can form an extension of the latter. They can be cleaned mechanically or pneumatically from adhering particles. It is advantageous to reduce their heat conductivity by pressing-on with a refractive material so that the impacting particles in a hot product gas stream have a surface temperature such that they drip as liquid slags. The impact surfaces of the contact surfaces 6 and 7 must start in such a height in the gasification reactor that these particles are sufficiently liquid.

It will be understood that each of the elements described above, or two or more together, may also find a useful application in other types of constructions differing from the types described above.

While the invention has been illustrated and described as embodied in a method of radiation cooling and a radiation cooler, it is not intended to be limited to the details shown, since various modifications and structural changes may be made without departing in any way from the spirit of the present invention.

Without further analysis, the foregoing will so fully reveal the gist of the present invention that others can, by applying current knowledge, readily adapt it for various applications without omitting features that, from the standpoint of prior art, fairly constitute essential characteristics of the generic or specific aspects of this invention.

What is claimed as new and desired to be protected by Letters Patent is set forth in the appended claims.

We claim:

1. A method of radiant cooling of a product gas mass stream discharged from a gasification reactor and loaded with particles in a cylindrical radiant cooler with a radiant cooling casing, comprising the steps of subdividing the product gas mass stream into concentric cylindrical layer streams by cylindrical radiant cooling walls arranged at a distance from the radiant cooling casing; adjusting layer thickness of the cylindrical layer streams to provide a high radiant heat exchange; and cooling regions of the product gas mass stream which flow to the radiant cooling walls in a pre-cooling region to a temperature excluding the caking of the particles, said subdividing of the product gas stream into the cylindrical layer streams including such a subdividing that the layer thickness of the cylindrical layer streams substantially equals to a double amount of a thickness of a layer with an emission degree of approximately 0.86.

2. A method as defined in claim 1, wherein said subdividing of the product gas mass stream into the cylindrical layer streams includes such subdividing that the cylindrical layer streams are composed of thin partial layers for heat exchange by radiation between a gas and a wall.

3. A method as defined in claim 1, wherein the product gas mass stream has central regions which meet further downstream with the cylindrical radiant cooling walls in radiant heat exchange than regions which are located closer to the radiant cooling casing.

4. A method as defined in claim 1; and further comprising the step of guiding the product gas mass stream with a flow profile which is substantially free from transverse streams.

5. A radiant cooler for radiant cooling of a a product gas mass quantity from a gasification reactor, comprising a cylindrical radiant cooling casing having an axis; means forming a product gas inlet for supplying the product gas mass stream and an outlet for a radiant-cooled product gas; additional radiant cooling walls located in the region of said radiant cooling casing, said additional radiant cooling walls being formed as cylindrical radiant cooling walls and arranged in a flow direction of the product gas after the pre-cooling region concentrically relative to one another and at a distance from said radiant cooling casing to form cylindrical layer streams and cooled to a temperature excluding the caking of particles emitted from said gasification reaction product gas, said cylindrical radiant cooling walls being spaced from said radiant cooling casing and from one another by a distance which is 0.5–3 times the thickness of a layer having an emission degree of approximately 0.86.

6. A radiant cooler as defined in claim 5, wherein said pre-cooling region is formed as a substantially parabolic-rotation, insert-free chamber which is connected with said product gas inlet and is parabola-shaped narrower downstream and surrounded by said radiant cooling casing.

7. A radiant cooler as defined in claim 6, wherein said cylindrical radiant cooling walls have flow edges which are adjoined in a parabolic shape with said pre-cooling region.

8. A radiant cooler as defined in claim 5, wherein said radiant cooling casing and said cylindrical radiant cooling walls have a length selected in accordance with the law of radiant cooling in the flow direction of the product gas.

9. A radiant cooler as defined in claim 5, wherein said radiant cooling walls are spaced from one another equidistantly.

10. A radiant cooler as defined in claim 5, wherein said radiant cooling walls are spaced from one another by distances which increase toward said axis.

11. A radiant cooler as defined in claim 5, wherein said cylindrical radiant cooling walls start at a constant height inside the gasifying reactor.

12. A radiant cooler as defined in claim 5; and further comprising at least one impact surface arranged before said cylindrical radiant cooling walls as considered in the flow direction of the product gas.

13. A radiant cooler as defined in claim 5; and further comprising at least one contact surface arranged before said cylindrical radiant cooling walls as considered in a flow direction of the product gas.

14. A radiant cooler as defined in claim 11; and further comprising a contact surface arranged before said cylindrical radiant cooling walls as considered in the flow direction of the product gas.

* * * * *